US008454017B2

(12) United States Patent
Ward et al.

(10) Patent No.: US 8,454,017 B2
(45) Date of Patent: Jun. 4, 2013

(54) PARTIAL-DECK POKER GAME WITH GUARANTEED ROYAL FLUSH OPPORTUNITY

(76) Inventors: Bradley G. Ward, Henderson, NV (US); Anthony N. Cabot, Las Vegas, NV (US)

( * ) Notice: Subject to any disclaimer, the term of this patent is extended or adjusted under 35 U.S.C. 154(b) by 127 days.

(21) Appl. No.: 10/422,395

(22) Filed: Apr. 23, 2003

(65) Prior Publication Data

US 2004/0212147 A1 Oct. 28, 2004

(51) Int. Cl.
*A63B 71/00* (2006.01)

(52) U.S. Cl.
USPC ..... 273/138.1

(58) Field of Classification Search
USPC ..... 273/138.1, 274, 309; 463/13
See application file for complete search history.

(56) References Cited

U.S. PATENT DOCUMENTS 4,560,161 A * 12/1985 Hamano ..... 463/13
4,560,171 A * 12/1985 Anthony ..... 273/269
5,019,973 A * 5/1991 Wilcox et al. ..... 463/13
5,029,598 A * 7/1991 Stroszynski et al. ..... 137/1
5,029,871 A * 7/1991 Willson et al. ..... 273/271
5,033,744 A * 7/1991 Bridgeman et al. ..... 463/13
5,092,598 A * 3/1992 Kamille ..... 273/139
5,100,139 A * 3/1992 Di Bella ..... 273/292
5,823,873 A * 10/1998 Moody ..... 463/13
5,975,529 A * 11/1999 de Keller ..... 273/292
6,050,568 A * 4/2000 Hachquet ..... 273/292
6,132,311 A * 10/2000 Williams ..... 463/13
6,149,157 A * 11/2000 Suan ..... 273/292
6,270,405 B1 * 8/2001 Ferguson ..... 463/13
6,312,334 B1 * 11/2001 Yoseloff ..... 463/25
6,435,500 B2 * 8/2002 Gumina ..... 273/139
6,454,651 B1 * 9/2002 Yoseloff ..... 463/25
6,474,645 B2 * 11/2002 Tarantino ..... 273/274
6,508,470 B1 * 1/2003 Yuan ..... 273/292
6,726,561 B2 * 4/2004 Crawford ..... 463/13
6,749,501 B2 * 6/2004 Crawford ..... 463/13
2002/0187823 A1 * 12/2002 Khal ..... 463/13
2011/0095481 A1 * 4/2011 Patelidas ..... 273/292

* cited by examiner

*Primary Examiner* — Gene Kim
*Assistant Examiner* — Dolor Collins
(74) *Attorney, Agent, or Firm* — Weide & Miller, Ltd.

(57) ABSTRACT

In a poker type game cards numbering less than those in a standard deck of card are used to form a field of cards and a set of dealt cards. The cards of the field of cards are displayed face down. The set of dealt cards are displayed face-up. The combination of the cards in the field of cards and set of dealt cards includes at least one Royal Flush combination. The player discards cards from the set of dealt cards and selects replacement cards to the discarded cards from the field of cards. The player's hand is formed from the set of dealt cards, less any discarded cards, plus the replacement cards. The player's hand is a winning hand if it is a predetermined winning combination of cards. At the conclusion of the game, the cards in the field of cards are displayed to the player.

26 Claims, 4 Drawing Sheets

PARTIAL-DECK POKER GAME WITH GUARANTEED ROYAL FLUSH OPPORTUNITY

FIELD OF THE INVENTION

The present invention relates to a poker type game, and in particular to a poker type game in which less than 52 cards are used and in which the opportunity to obtain a Royal Flush is guaranteed.

BACKGROUND OF THE INVENTION

Poker is one of the most popular card games. The game of poker originated as a table game. Now, the game of poker has been implemented in video form using electronic gaming machines.

Various forms of poker may be implemented in video poker form. In general, in the play of these games a number of cards are dealt or displayed to a player. One or more of those cards are used to form the player's hand. In some instances, the dealt cards comprise the player's hand. In other variations, a player is dealt a greater number of cards than will form the player's hand, and thus the player must discard one or more cards. In other variations, a player is permitted to replace one or more dealt cards.

In the game of video poker, the player plays against the house or a pay table. In this configuration, a player is declared the winner of the game if they obtain one of the predetermined winning hands. The player is generally paid winnings depending upon the ranking of the hand. A winning combination of cards may include a Pair, a Three of Kind, a Full House, a Straight, a Flush, a Four of a Kind, a Straight Flush and/or a Royal Flush. A number of variations of winning hands may be defined.

As indicated, video poker machines are configured to display dealt and drawn cards to a player using a video display. The video poker machine uses electronics to generate the images of the cards. So that the selection of cards is random, just like when cards are dealt from a shuffled deck, the electronics include a random number generator. The random number generator randomly generates numbers which correspond to particular cards. Cards used in the game are thus selected by the random generation of numbers. The "selected" cards are displayed to the player on a video display. Replacement cards, if any, are similarly selected or drawn using the random number generator.

There are several drawbacks to the game of video poker. Players often have the perception that video games are programmed to generate a disproportionately low number of winning results as compared to the true odds of receiving winning results when playing with physical cards. In particular, because the game is not played with physical cards that the player can see and hold, the player may believe that the gaming machine may easily be programmed to deal or display particular cards which do not yield, or yield infrequently, winning hands. In other words, the player may have the perception that the gaming machine is not configured to deal or display cards in the same manner or with the same odds as if the player were playing the game with a real deck of cards. For example, a player who has four cards of the same suit may on several occasions draw a fifth card which is of a different suit, and thus not obtain a winning Flush hand. The player may believe that the machine is programmed so that they do not receive a card which results in the winning hand except on rare occasions.

As one means of addressing this issue, U.S. Pat. Nos. 6,149,157 and 4,560,161 both describe a method of playing video poker in which an entire deck of cards is displayed on video display of a gaming machine. In these configurations, the entire deck of cards which is used to play the game is displayed to the player. The player is permitted to pick cards to be used in their hand from the deck of cards. In this manner, the player's perception is that they have control over the cards used in the game and that the gaming machine is not selecting the cards in a manner disfavorable to them.

This method of game play, however, has several disadvantages. First, the game requires that all of the cards of an entire deck of cards be displayed. This causes the field of cards which is displayed to be too large. In the case of a video poker machine, the size of the video screen would require that for all the cards to be displayed that each individual card be very small. Otherwise, all of the cards could not be displayed on the screen. This is undesirable to players, who find the cards difficult to read if they are small. In addition, in the case of games played on touch screens, the cards may be so small that the player has difficulty in "touching" the desired card. This may lead to mistakes, such as a player selecting the wrong card.

Another problem with the display of the complete set of the deck of cards is that the cards can not be displayed in an n×n or n×m matrix. It is generally acknowledged as desirable to display game symbols, such as cards, in such a matrix format, and that it is less desirable to display such symbols in other formats. In particular, when cards are not displayed in a square or rectangular matrix, one or more symbols appear to be displayed "alone" and thus appear different to the player. This may lead the player to believe that some trick is being played. In the case of a square or rectangular matrix, all symbols appear to have the same characteristics and none is distinguishable from the others.

In normal poker play, including video poker, the penultimate hand is the Royal Flush. In the case of the game of video poker, this hand generally yields the highest winning payout. As such, a player's desire to obtain that hand of cards is higher than all others.

Unfortunately, the odds of receiving a Royal Flush are quite low. Players know this and thus this to some degree detracts from the game. Another problem with the above-referenced U.S. Pat. Nos. 6,149,157 and 4,560,161 is that they still utilize the same single deck format as is generally used in the game of poker, and thus offer the same low probability of receiving a Royal Flush.

An improved method of poker game play is desired which is particularly suited to video adaption and which is viewed as favorable to a player.

SUMMARY OF THE INVENTION

The invention is a method of playing a game and a gaming machine for presenting a poker-type game. The poker type game is played with a set of cards numbering less than the cards of a standard single deck of cards. The game provides a guaranteed opportunity for a Royal Flush.

In one embodiment, a field of cards is displayed. The field of cards is preferably displayed face-down. The number of cards in the field of cards is less than the number of cards in a standard single deck of cards. In one embodiment, the field of cards comprises 20-30 cards.

A set of dealt cards is displayed. In one embodiment, the set of dealt cards comprises cards other than those of the field of cards. In another embodiment, the set of dealt cards are selected from the field of cards. The dealt cards are preferably displayed face-up or are dealt or displayed face-down and then turned over so as to be exposed to the player.

In a preferred embodiment, the total number of cards in the field of cards and the set of dealt cards is less than the number of cards in a single deck of cards (i.e. less than 52 cards). The cards used in the field of cards and set of dealt cards may, however, be selected from a single deck or multiple decks of cards.

In one embodiment, the game is played with a "draw" feature, in which a player may elect to discard and replace one or more dealt cards. As such, a player makes selections regarding the none, one or more cards of the set of dealt cards to keep or hold, or to discard. In the event the player discards any of the dealt cards, the player selects replacement cards from the field of cards. The player selects a replacement card for each discarded card.

Most importantly, the game provides a guaranteed opportunity for the player to receive a Royal Flush. In particular, when considering the cards in the field of cards and the cards dealt to the player, there is at least one combination of cards which comprises a Royal Flush. That combination of cards may be dealt to the player, or may only be obtained by discarding one or more of the dealt cards and selecting the correct replacement cards from the field of cards.

After the player has selected any desired replacement cards, the player's cards, which comprise a hand, are evaluated. The outcome of the game is a winning outcome in the event the player's cards comprise a predetermined hand or combination of cards.

At the end of the game, the cards in the field of cards are preferably turned over or exposed. In that manner, the player may see the actual cards or the card values and their locations. This may be used by the player to determine "how close" they were to receiving the hand they were playing for.

In one embodiment, if the player did not obtain a Royal Flush, the cards forming the one or more Royal Flushes are highlighted to the player to verify to the player the existence of cards which would have formed a Royal Flush. The player's discard cards may continue to be displayed so that, in the event one of those cards comprises one of the cards forming the Royal Flush, that fact is apparent to the player.

In one embodiment, the game is played as a wagering game. In that event, a player may be required to place a wager or bet in order for the chance to obtain a payout or award for a winning result.

Further objects, features, and advantages of the present invention over the prior art will become apparent from the detailed description of the drawings which follows, when considered with the attached figures.

DETAILED DESCRIPTION OF THE INVENTION

The invention is a method and apparatus for playing a poker type game. In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

In general, the invention is a method of playing a poker type game. Preferably, the game is implemented by a gaming machine including a video display. In general, the invention includes the step of displaying a field of cards. Cards are dealt to the player, either automatically or by player selection from the field of displayed cards.

The cards comprising the field of cards and dealt cards number less than those in a standard deck of cards (whether those cards are selected from a single deck or multiple decks). In addition, the cards dealt to the player along with the cards in the field of cards include at least one combination of cards which comprises a Royal Flush.

The player may be permitted to replace one or more of the dealt cards by selection from the cards in the field of displayed cards. The player's resulting hand of cards determines the outcome of the game.

Figure 1:
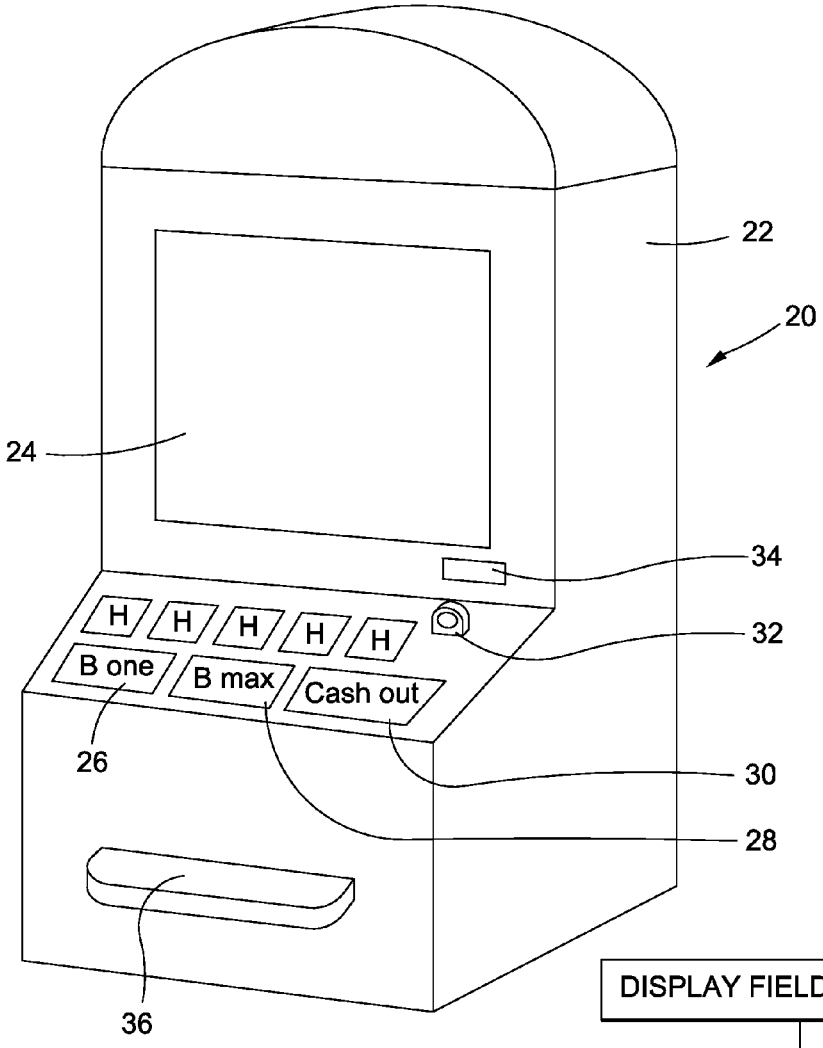
FIG. 1 illustrates a gaming machine of the type which may be configured to present a game in accordance with the present invention.

The game of the invention will now be described in more detail. In a preferred embodiment, the game is presented on a gaming machine such as that illustrated in FIG. 1. As illustrated, a gaming machine or device 20 includes a housing 22 containing or supporting various components. The gaming machine or device 20 is, either alone or in combination with other devices, preferably configured to present a game of the invention. It will be appreciated that the housing 22 may have a variety of shapes and configurations.

As illustrated, the gaming machine 20 is a "video" type gaming device, and as such includes a video display 24. The display 24 may be of a variety of types now known or later developed, such as CRT, plasma, LCD or others. In general, the display 24 is configured to present information for viewing by a player of the gaming machine 20.

Means are provided for generating video content regarding a game, the video content provided to the video display 24 for display. In one embodiment, a gaming controller includes a processor and a memory. The memory stores software which is executed by the processor. The executed code creates video data which is provided, such as via a video controller, to the video display, causing the display to display game play information. The gaming controller is preferably located inside of the housing 22 of the gaming machine 20.

A wide variety of means may be provided for generating the video content. For example, in one embodiment, game data may be generated remotely, such as at a remote game server. The game data may then be downloaded to the gaming machine 20 via a wired or wireless communication link.

The gaming machine 20 preferably includes one or more player inputs which permit the player to interact with the gaming machine 20. In the embodiment illustrated, the gaming machine 20 includes a plurality of push-buttons. As illustrated, a "bet one" button 26, a "bet max" button 28 and a "cash out" button 30 may be provided. The functions of these buttons 26,28,30 are described in more detail below.

A wide variety of other inputs may be provided, varying both in form and function. For example, in one embodiment, the video display 24 may comprise a "touch screen" type display. Other inputs, such as a rotatable arm (as is well known in the art of slot machines) may be provided. Each input preferably provides input, such as by way of an electrical signal, to the gaming controller or other game content generating device. In that manner, game play is interactive.

In one embodiment, the gaming machine 20 is configured to present a game only upon a player placing a bet, wager, or payment. Thus, the gaming machine 20 may include means for accepting value. As illustrated, the gaming machine 20 may include a coin acceptor 32. The coin acceptor 32 may be configured to accept coins of one or more denominations. A coin sorter, coin hopper and other coin holding and processing devices may be located in the housing 22 of the gaming machine 20.

The gaming machine 20 may also or alternatively include a bill validator 34. The bill validator 34 may be configured to accept paper money of one or more denominations. A bill stacker and other bill processing and storage devices may be located in the housing 22 of the gaming machine 20.

The gaming machine 20 may also or alternatively include a ticket reader, smart card, credit card or other media acceptor/reader. Such devices may be utilized to obtain information regarding value, such as credit card account information or bar-coded ticket value.

When value is provided to the gaming machine 20, the gaming machine 20 may be configured to display information regarding the provided value, such as in the form of "credit" information. This information may be displayed, for example, on the video display 24.

The player may utilize inputs to place a wager, bet or provide payment to play a game. For example, a player may depress the "bet one" button 26 to bet or wager a single credit. A player may depress the "bet max" button 28 to bet or wager the maximum credits which can be wagered for a game.

In one embodiment, the gaming machine 20 is configured to award winnings for winning outcomes of games played. The winnings may be paid or provided to the player in a variety of manners. In one embodiment, awards may be indicated in the form of credits. Thus, when a player wins, the total number of credits belonging to them is increased, and the increased amount may be displayed on the display 24. The player may utilize the awarded credits to play future games.

In another embodiment, the player may be awarded money, or may convert credits to money. As illustrated, the gaming machine 20 may include a coin tray 36 into which coins may be dispensed. The coins may represent a specific award. Alternatively, the player may utilize the "cash out" button 30 and be paid the value of their credits in the form of coins.

Other forms of payment may be provided, such as by issuance of a ticket which represents value. Non-monetary prizes may also be awarded. For example, credits may be redeemed for prizes or a ticket or tickets may be redeemed for specific prizes or general prizes. In other embodiments, game play may be for entertainment purposes only and no prize or award may be won. In one embodiment, a player may win points which the player can accrue and use, such as for free game play. In another embodiment, no payment need be provided. For example, the game may be played for recreational purposes only. In other embodiments, points may be awarded, the points having no "value," except to provide the player an indication of the level of success of play of the game. Such a level of points may be compared, for example, to the level of points achieved by other players.

The gaming machine 20 illustrated and described is just one embodiment of a device which may be used to present a game in accordance with the invention. Other devices may be utilized.

The gaming machine 20 may also comprise a computing device, such as a laptop or desktop computer. Game information may be transmitted via a communication link to a remote player. The communication link may include, for example, the Internet. The game information may be utilized by the remote player's computer, such as by displaying game information on an associated screen. A player may provide input via a keyboard, mouse or other input device. Other devices such as PDA's, cellular phones or other devices may be used to present the game of the invention.

As described in more detail below, in one or more embodiments, the game of the invention need not be presented on an electrical or electromechanical device. For example, the game may be presented using physical playing cards.

One embodiment of a game of the invention will now be described with reference to FIG. 2. In a first step S1, a field of cards 102 is displayed. As illustrated in FIG. 3, this may comprise the step of displaying images of cards on a display 100.

Preferably, the field of cards 102 comprises a number of cards which is less than that contained in a single standard deck of cards. In one embodiment, the field of cards contains between about 20 and 30 cards. The field may, however, be less than 20 or more than 30 cards. As illustrated, the field of cards comprises 20 cards.

In one embodiment, the cards 102 are displayed in a face-down position so that the player can not determine the value of the card. In one embodiment, representations of cards or card positions may be displayed instead of the reverse side of a card. Preferably, however, the reverse or back side of cards are displayed.

In one embodiment, the cards in the field of cards 102 (or card positions) represent actual cards from one or more standard decks of cards. Preferably, the cards of the field of cards 102 are selected from a single standard deck containing 13 cards of 4 suits for a total of 52 cards. The cards of the field of cards 102 may, however, be selected from a plurality of decks of cards, or decks of other than 52 cards, such as decks including the standard 52 cards and one or more wildcards.

The cards in the field of cards 102 may be displayed in a variety of manners. Preferably, as illustrated, the cards 102 are displayed in a matrix or rows and columns. It is preferred that the field of cards 102 include a number of cards which permits the cards to be displayed in an n×m matrix, and more preferably, an n×n matrix as in the case of 16(4×4), 25(5×5) or 36(6×6) cards. In a more preferred embodiment, the number of cards in the field of cards 102 is selected so that those cards and the cards in a set of dealt cards (described in detail below) may be displayed in a n×m or n×n matrix. For example, where there are five cards in the set of dealt cards, there are preferably 20 cards in the field of cards 102, so that all these cards combined may be displayed in a 5×5 matrix.

In one embodiment, where the game is presented at a gaming machine, a gaming controller is configured to generate data used by the display 100 to generate the representations of the cards of the field of cards 102. For example, the gaming controller may be configured to execute software for accomplishing such a function.

In one embodiment, a random number generator is utilized to select the cards of the field of cards 102. For example, a random number generator may be configured to generate a set of numbers representing the cards in the field of cards 102, the set of numbers randomly selected from a set of numbers corresponding to all cards in a deck or decks of cards.

Figure 4:
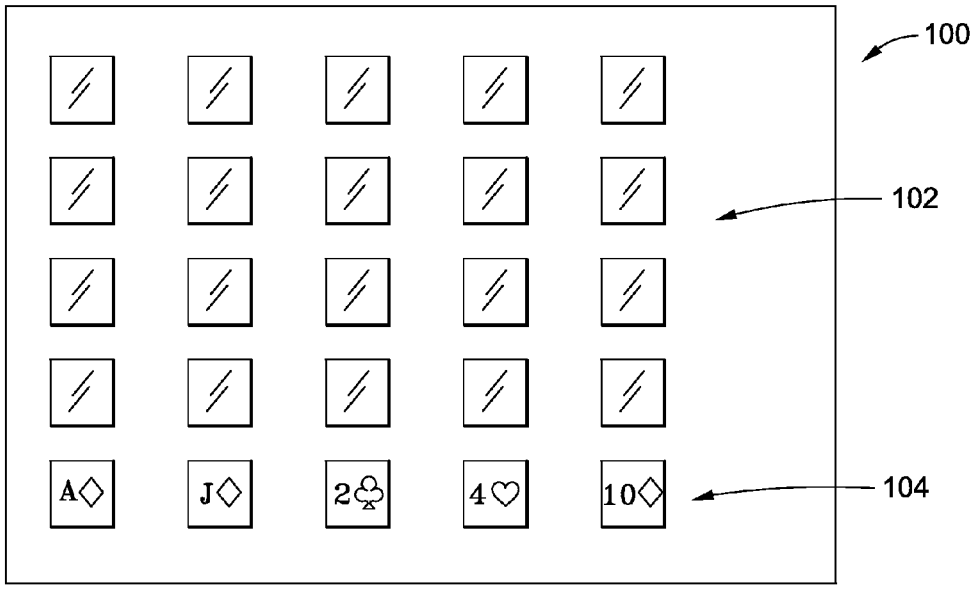
FIG. 4 illustrates the field of cards illustrated in FIG. 3 along with a displayed set of dealt cards.

Referring again to FIG. 2 and also to FIG. 4, in a step S2, cards comprising a set of dealt cards 104 is dealt or displayed to a player. As illustrated in FIG. 4, the set of dealt cards 104 is preferably dealt or displayed face-up to the player so that the card values are known or visible to the player. In another embodiment, the set of dealt cards 104 may be dealt face down, with the player having the opportunity to turn them over. This set of dealt cards 104 preferably comprises a base set of cards for use by the player in forming a hand which is used to determine the outcome of the game.

The set of dealt cards 104 may be dealt to the player in a variety of fashions. Preferably, the set of dealt cards 104 is generated and displayed to the player automatically without any player involvement or selection. In one embodiment, the set of dealt cards 104 comprise cards other than those which are in the field of cards. For example, if the field of cards 102 comprises 20 of 52 cards of a deck, the set of dealt cards 104 may comprise cards selected from the remaining 32 of the cards of the deck not used in the field of cards.

This embodiment has the distinct advantage that the speed of play is increased. In particular, the gaming machine may be configured to automatically electronically generate the field of cards 102 and set of dealt cards 104 and display them to the player. This speeds play of the game compared to that where, as detailed below, the player makes selections of cards to be used as the set of dealt cards 104.

As indicated, the set of cards 104 which are dealt to the player may be selected by the player from the field of cards 102. In other words, the player may be permitted to make selections of particular cards from the field of cards 102, and those selected cards are dealt or displayed to the player. Of course, it will be appreciated that when the cards in the field of cards 102 are face-down, when the player makes selections, the player does not know the value of the cards which are being selected.

The number of cards in the set of dealt cards 104 may vary. In one embodiment, five cards are dealt to the player. The number of cards may depend upon a variety of circumstances, including the particular game being played. Preferably, the total number of cards in the set of dealt cards 104 and in the field of cards 102 is less than the number of cards in a standard deck of cards.

Regardless of how the set of dealt cards 104 which are dealt to the player are generated (automatically, by player selection or the like), preferably, one or more cards in the field of cards 102 and one or more of cards of the set of dealt cards 104 comprises a Royal Flush. In other words, when considering the cards in the field of cards 102 and those dealt to the player, the player has a guaranteed opportunity to receive a Royal Flush.

In one embodiment, the cards comprising the Royal Flush may be dealt to the player. For example, the set of dealt cards 104 may comprise the cards A, K, Q, J and Ten in the suit of Hearts. In one embodiment, the cards comprising the Royal Flush may be located only in the field of cards 102. In another embodiment, select cards in the field of cards 102 along with one or more of the cards 104 dealt to the player will generate a Royal Flush.

It will be appreciated that in this configuration, the cards which are generated for use in the game and comprise the field of cards 102 and the cards which are dealt to the player must be specifically selected or generated to ensure that a Royal Flush opportunity exists.

For example, in the event the player selects the cards which comprise the set of dealt cards 104 from the field of cards 102, then the cards in the field of cards 102 must be generated in a manner which ensures that at least one set of cards in the field of cards 102 comprises a Royal Flush. In this manner, the player has the opportunity when selecting their set of dealt cards 104 or replacement cards (as described below) to receive a Royal Flush.

In the event the set of dealt cards 104 are generated and displayed to the player automatically and those cards are distinct from the cards of the field of cards 102, then it must be ensured that the combination of those cards will yield at least one Royal Flush.

By Royal Flush it is meant at least one of the following four combinations of cards: A, K, Q, J and Ten of the cards of the same suit. In some embodiments, one or more wildcards may be used and the Royal Flush may be created using one or more of those wildcards. Of course, in accordance with the invention, cards in the field of cards 102 and set of dealt cards 104 may yield combinations of more than one Royal Flush.

In one embodiment, the method may comprise the selection of a sub-set of cards from a single deck (or in other embodiments, multiple decks) of cards. The sub-set of cards is selected to ensure that the sub-set includes at least one combination of cards which will form a Royal Flush. The set of dealt cards 104 may be selected automatically or by the player from this sub-set of cards, and the remainder of the cards of the sub-set may be displayed as the field of cards 102.

In a preferred embodiment of the invention, the poker type game is played as a "draw" type game. As such, referring to FIGS. 2 and 5, in a step S3, the player is permitted to hold none, one or more of the cards from the set of dealt cards 104. In one embodiment, this comprises the step of accepting input from a player regarding the particular card or cards in the set of dealt cards 104 which the player wishes to hold or discard. For example, a gaming machine may include a "hold card" button (see FIG. 1) corresponding to each card position.

Figure 5:
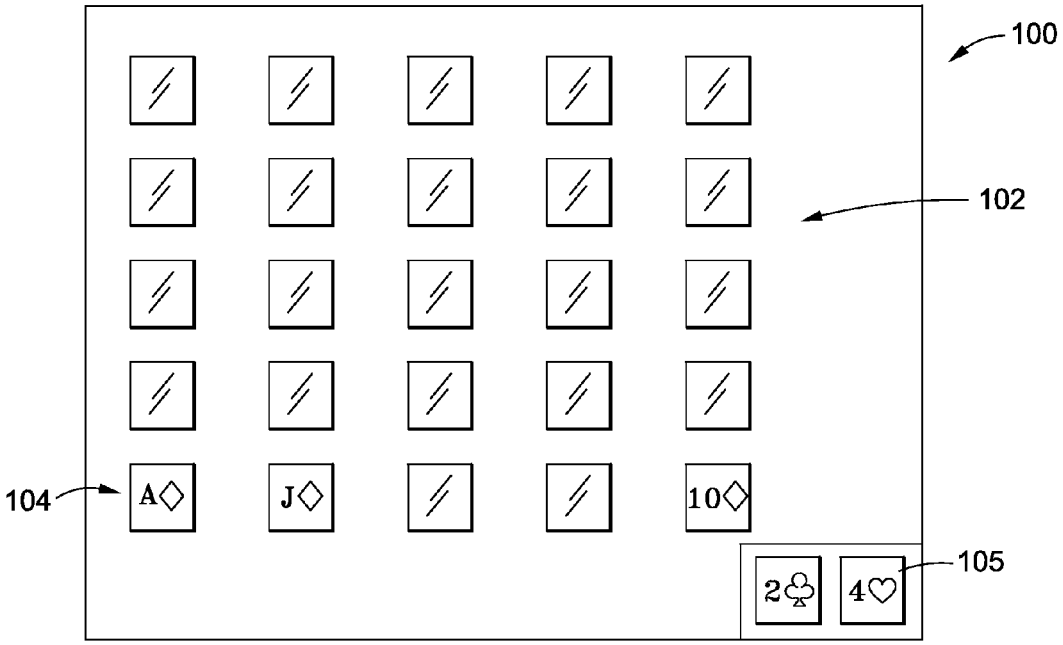
FIG. 5 illustrates the field of cards and set of dealt cards illustrated in FIG. 4 after cards from said set of dealt cards have been discarded by a player.

Cards which are not held are discarded. By "discarded" it is meant that the cards no longer form a part of the set of dealt cards 104. In one embodiment, as illustrated in FIG. 5, any discarded cards 105 are removed from the player's hand 104, but are still displayed to the player. For example, as illustrated, the discarded cards 105 may be re-displayed in a separate "discard" area apart from the player's hand 104. The discarded cards 105 may be illustrated in smaller size, may be darkened or the like so that the player can easily distinguish the discarded cards 105 from the other cards used in the game.

Figure 2:
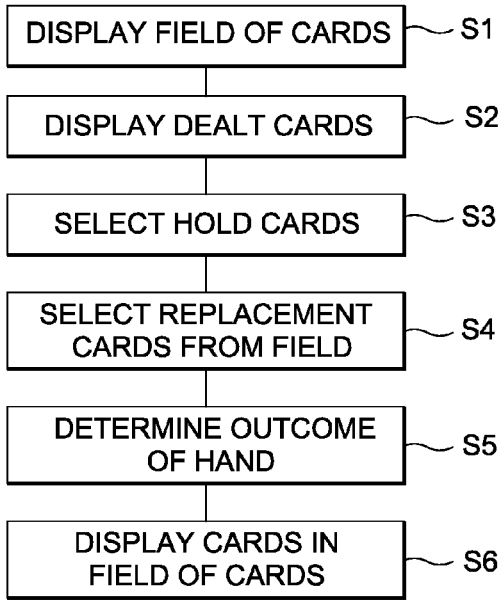
FIG. 2 is a flow chart illustrating one embodiment of a method of the invention.
Figure 3:
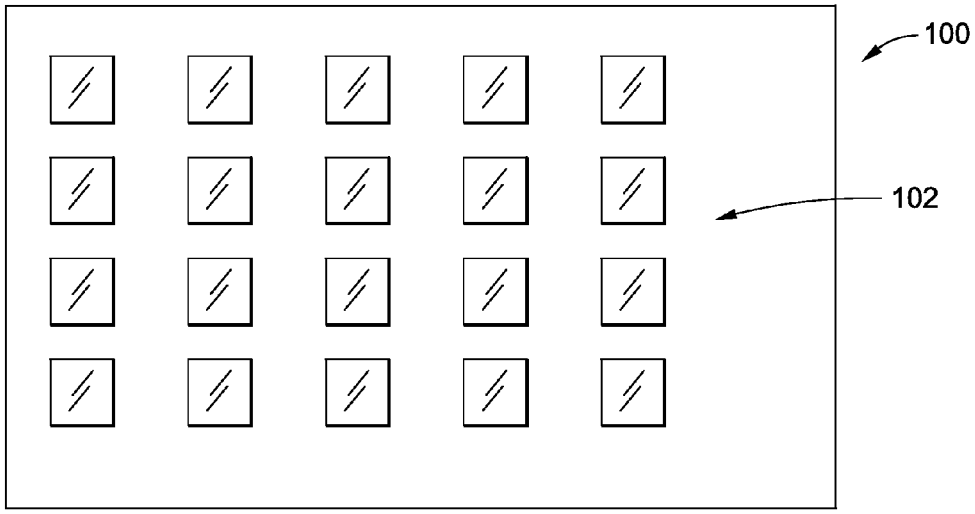
FIG. 3 illustrates a field of cards displayed in accordance with a game of the invention.
Figure 6:
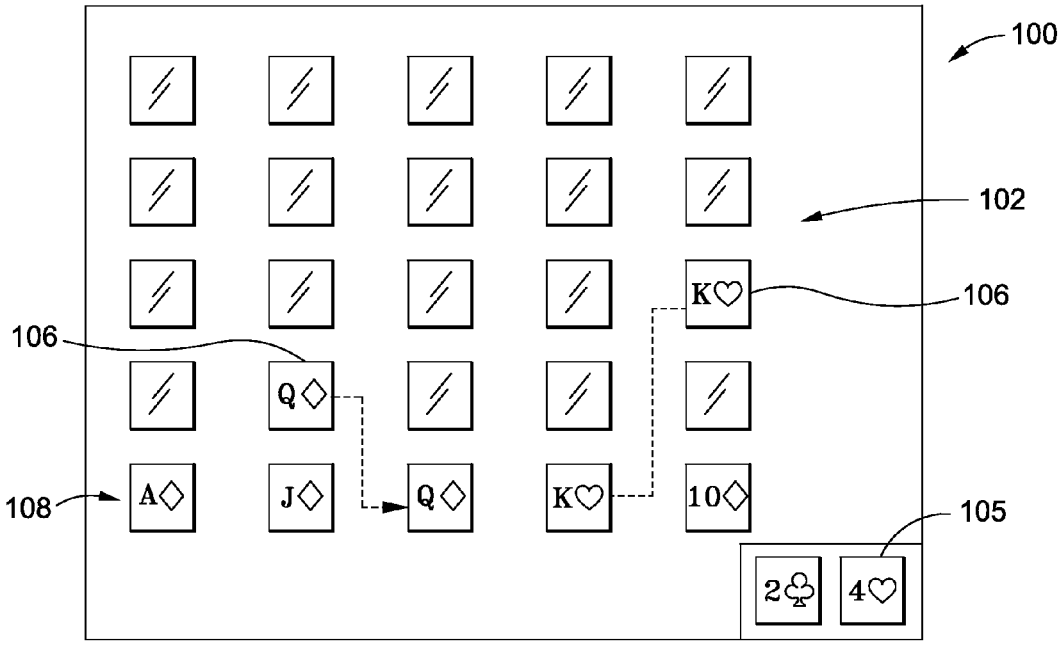
FIG. 6 illustrates the field of cards after a player has made replacement card selections and the replacement cards have been associated with the dealt cards not discarded to form a player hand.

Referring to FIGS. 2 and 6, in a step S4, a player selects a replacement card 106 for each card in the set of dealt cards 104 which is not held. Otherwise stated, the player selects a replacement card 106 for each discarded card. If the player held all of the dealt cards 104, then the player has no cards to replace. If the player has cards to replace, then in a preferred embodiment, the player selects replacement cards 106 from the field of cards 102.

In one embodiment, once the player has made discard or hold selections from the set of dealt cards 104, the cards in the field of cards 102 is highlighted so as to indicate that the field of cards 102 is active and the player can make replacement card selections from the field of cards.

Preferably, each replacement card 106 which is selected is displayed to the player. In one embodiment, each replacement card is shown along with the cards from the set of dealt cards 104 which were held by the player. In another embodiment, or in addition, the replacement cards 106 may be displayed in the field of cards 102. For example, the selected replacement cards 106 may be turned over and displayed in the field of cards 102.

Figure 7:
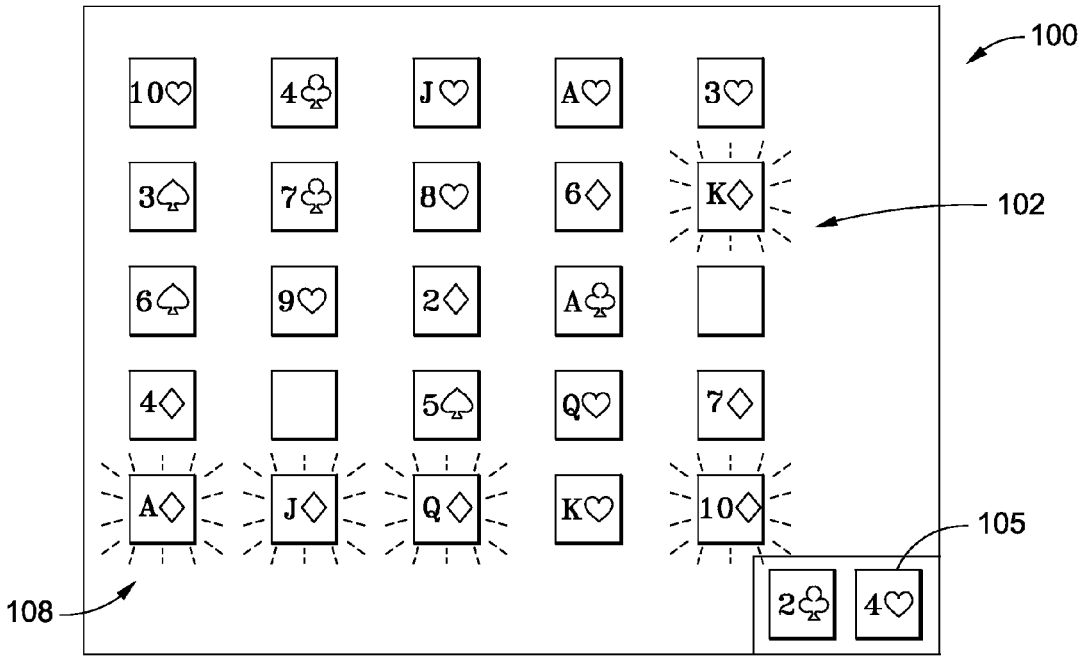
FIG. 7 illustrates the displaying of the field of cards after the conclusion of the game of the invention.

In another embodiment, as illustrated, in FIGS. 6 and 7, the replacement card or cards 106 may be "moved" from the field of cards 102. Once moved, the space occupied by the selected replacement card 106 may be displayed as an empty, blank or otherwise card selected position.

The player selects replacement cards until a hand of cards 108 is formed, as illustrated in FIG. 6. As described above, the hand may be of a variety of sizes. As illustrated, the hand 108 comprises 5 cards.

Referring again to FIG. 2, in a step S5, the outcome of the game is determined. This preferably comprises comparing the player's hand of cards 108 to one or more predetermined winning combinations to determine if the player's hand 108 comprises a winning combination of cards. The winning combinations may vary, but are preferably one or more of the "standard" poker hands, such as Three of Kind, a Flush, a Straight, Four of a Kind, a Full House, a Straight Flush and a Royal Flush. In one embodiment, winning hands may include a Pair, or a Pair having a certain value, such as a Pair of Jacks or better.

In the preferred embodiment of the invention, once the game has concluded, in a step S6, the cards in the field of cards 102 are turned over or otherwise displayed. This step is illustrated by example in FIG. 7. In one embodiment, if the player did not receive a Royal Flush hand, the cards which the player needed to obtain such a hand may be highlighted to clearly identify to the player that such a combination of cards existed and that the player would have received a Royal Flush had the player made the correct decisions.

The highlighting or other indication of the Royal Flush card may be by making those cards appear brighter, of a different color or by other visible indication to the player. In one embodiment, if multiple Royal Flush combinations exist, each of those combinations may be highlighted. The different combinations may be highlighted differently. For example, cards comprising a Royal Flush for one suit may be highlighted in the color blue, while the cards of another suit highlighted in the color green.

It will be appreciated that one or more of the cards which are capable of forming the Royal Flush may have been discarded by the player. In such event, the discarded card or cards are preferably highlighted with the other cards which form the Royal Flush set of cards. This is an advantage of displaying the discarded cards to the player, as illustrated in FIGS. 5-7. Because the discarded cards remain visible, they may easily be highlighted in this step if they comprise one of the cards forming the Royal Flush combination or set of cards.

In one embodiment, the game may be presented as a wagering type game. In such event, in order for a player to be entitled to play the game, or play the game for the opportunity of an award, the player must place a wager or bet. The size and nature of the wager or may vary. In the case of the gaming machine 20 illustrated and described above, the wager or bet may represent monetary value. The monetary value may be provided by the player in the form of coin or currency, or may comprise credit representing the same value.

Of course, the game may be presented for entertainment purposes only, in which case a bet or wager may not be required. In other embodiments, however, instead of a bet or wager a player may be required to provide information in order to play the game. For example, in the case of a game presented over the Internet by a provider, the player may be required to identify themselves or otherwise provide information in order to play the game.

In accordance with the invention, a player may be awarded an award for receiving a winning outcome. The award may be in the form of money, a physical prize, points or other elements or items. In an embodiment where a player is required to place a monetary wager to play the game, the award is preferably a monetary award. The size of the award may vary depending upon the outcome. For example, a larger award may be awarded for outcomes having a lower probability of occurrence.

Of course, the game of the invention may be implemented in a variety of other fashions. The game could be implemented using other machines. As described above, the game could be presented on a home computing device such as a laptop or desktop computer running computer readable code (e.g. software). The game could be presented on the display of a cellular phone, personal data assistant (PDA) or other device. The game may be presented on a stand-alone device or in a networked environment such as a cellular phone system, local area network (LAN), wide area network (WAN) or a global communication network such as the Internet.

In one embodiment, the game may be presented at a table using physical cards. For example, in accordance with the steps described, cards may be placed face-down on a table. Physical cards may be dealt and drawn in accordance with the steps of the invention.

As described above, the game is implemented as a five-card draw type poker game. The game could include the player receiving other numbers of dealt cards, could not include a "draw" feature or the like.

In one embodiment, as described, the game may be played against a paytable in which the player attempts to achieve a predetermined winning combination of cards. In another embodiment, one or more players could play against a house or bank hand. In one version, each player and the house/bank may play the game using separate field and dealt cards. In another version, the players and the house/bank may use the same field of cards.

In one embodiment, the game may be implemented as a multi-player game. In one version, a plurality of players may be independently provided sets of dealt cards. The player, however, may chose replacement cards from the same field of cards. In one embodiment, when a player makes a card selection from the field, the card is removed and not available to the other players.

In either the player vs. player or player vs. house/bank versions, a player may be declared the winner by achieving either the highest hand or a hand higher than that of the house/bank.

In one embodiment of the game, the cards comprising the field of cards may be displayed face up. The cards may then be turned over and "shuffled" into position in a manner preventing the player from tracking the cards to specific positions. This embodiment permits the player to see the cards that are going to be used in the play of the game before the game begins. In this embodiment, the set of dealt cards is preferably selected from the field of cards, so that the player knows that the set of dealt cards is selected from the cards which was displayed to them. In addition, in this embodiment, the cards comprising the Royal Flush(es) may be displayed or highlighted to the player when the cards are displayed so that the player can see that the cards which are being used in the game include at least one set of cards comprising a Royal Flush.

The game in accordance with the invention has numerous features and advantages which will now be described in more detail.

One aspect of the invention is a poker type game which is played with a number of cards which is less than the number of cards in a standard deck of cards. In accordance with the invention, the poker type game is preferably played with between 20 and 30 cards, instead of the 52 cards comprising a standard deck of cards.

One advantage to this configuration is that all of the cards which are used in the play of the game may be displayed on a video display. Further, the reduce number of cards used permits the cards to be displayed in a large size. This enables the player to see and identify each card in the field of cards which is used in the game.

Another advantage is that a number of cards can be used which permits their display in a matrix format, and preferably an n×n matrix.

A particularly advantageous feature of the invention is a poker type game which is played with a set of cards comprising less than all of the cards of a deck or with a lesser number of cards than comprises the number of cards in a standard deck, but which is guaranteed to contain at least one set of cards which comprises a Royal Flush. In this configuration, a player is provided a guaranteed opportunity to obtain a Royal Flush even though a small set of cards is used in the play of the game.

Another aspect of the invention is a game in which all of the cards used to play the game are displayed to the player. First, the cards which are used in the game are displayed in the field of cards and/or the dealt cards. No other cards are used in the game other than those displayed to the player. Further, once the game is over, all of the cards used in the game are turned over so that the player can identify each card used in the game.

As one aspect of this feature, if the player does not receive a winning outcome or receives other than the highest winning outcome, the player can see what cards they could have selected to obtain a winning result. For example, the player may have missed receiving a Royal Flush by receiving a Two of Hearts as a replacement card instead of the Jack of Hearts. After the field of cards is displayed, the player may see that the card next to the Two of Hearts that they selected was the Jack of Hearts card that they desired.

If the player did not receive a Royal Flush, the cards which comprise each possible Royal Flush are highlighted to the player. This allows the player to confirm that had they made the correct selections, they could indeed have received a Royal Flush. As described, in accordance with the method, the player's discarded cards preferably remained displayed to the player so that if the player's erroneous discard prevented them from receiving the Royal Flush, that fact is indicated to them.

It will be understood that the above described arrangements of apparatus and the method therefrom are merely illustrative of applications of the principles of this invention and many other embodiments and modifications may be made without departing from the spirit and scope of the invention as defined in the claims.

What is claimed is:

1. A method of playing a game at a gaming machine having at least one video display, and at least one player input device and a controller configured to execute the machine-readable code to cause said gaming machine to implement the steps of:

displaying a field of cards having a face bearing card indicia and an opposing back in a face-down position via said at least one video display;

dealing to a player a set of dealt cards and displaying said dealt cards via said at least one video display, the combination of dealt cards and cards in said field of cards comprising less than 52 cards and yielding at least one possible combination of a Royal Flush;

accepting input via said at least one player input device regarding none, one or more or all of said dealt cards which said player wishes to discard;

accepting selection via said at least one player input device from said field of cards a replacement card for each discarded card;

forming a player hand from cards from said set of dealt cards not discarded along with any replacement cards and displaying said player hand via said at least one video display; and determining the outcome of said game by determining if said player hand is a winning hand.

2. The method in accordance with claim 1 including the step of displaying said cards in said field of cards after said outcome is determined.

3. The method in accordance with claim 1 wherein said field of cards comprises between 20 and 35 cards.

4. The method in accordance with claim 1 wherein said set of dealt cards comprises five cards.

5. The method in accordance with claim 1 including the step of turning over each selected replacement card.

6. The method in accordance with claim 1 wherein said step of dealing said set of player cards comprises accepting selection from said player of a set of cards from said field of cards and displaying said selected cards to said player via said at least one video display.

7. The method in accordance with claim 1 wherein said set of dealt cards are selected from a deck of cards from which said field of cards have been removed.

8. A method of playing a game at a gaming machine comprising a housing, at least one player input device, at least one video display, and a controller configured to execute machine-readable code to cause said gaming machine to implement the steps of:

selecting a sub-set of cards from a set of cards comprising all of the cards of a single deck of cards, said sub-set of cards comprising at least one set of cards forming a Royal Flush;

dealing a set of player cards from said sub-set of cards and displaying said set of player cards to said player via said at least one video display;

displaying the remaining cards of said sub-set of cards in a field of cards via said at least one video display;

accepting input regarding none, one or more or all of said cards of said set of player cards to discard via said at least one player input device;

accepting selection of a replacement card from said field of cards for each discarded card via said at least one player input device;

forming a player hand comprising cards of said set of player cards not discarded plus any replacement cards and displaying said player hand via said at least one video display; and determining the outcome of said game by determining if said player hand is a winning hand.

9. The method in accordance with claim 8 wherein said sub-set of cards comprises 25-35 cards.

10. A computer program product for causing a gaming machine having at least one video display to present a game, comprising:

machine readable code stored in a tangible medium comprising:

instructions to cause said gaming machine to display a field of cards in a face-down position on said at least one video display of said gaming machine;

instructions to cause said gaming machine to deal to a player a set of dealt cards and display said dealt cards on said at least one video display of said gaming machine, the combination of dealt cards and cards in said field of cards comprising less than 52 cards and yielding at least one possible combination of a Royal Flush;

instructions to cause said gaming machine to accept input at said gaming machine regarding none, one or more or all of said dealt cards which said player wishes to discard;

instructions to cause said gaming machine to accept selection at said gaming machine from said field of cards a replacement card for each discarded card;

instructions to cause said gaming machine to form a player hand from cards from said set of dealt cards not discarded along with any replacement cards; and instructions to cause said gaming machine to determine the outcome of said game by determining if said player hand is a winning hand.

11. The computer program product in accordance with claim 10 wherein said code further comprises instructions to cause said gaming machine to display said cards in said field of cards after said outcome is determined.

12. The computer program product in accordance with claim 10 wherein said field of cards comprises between 20 and 35 cards.

13. The computer program product in accordance with claim 10 wherein said set of dealt cards comprises five cards.

14. The computer program product in accordance with claim 10 including the step of turning over each selected replacement card.

15. The computer program product in accordance with claim 10 wherein said instructions to cause said gaming machine to deal said set of player cards comprises instructions to accept selection from said player of a set of cards from said field of cards and display said selected cards.

16. The computer program product in accordance with claim 10 wherein said set of dealt cards are selected from a deck of cards from which said field of cards have been removed.

17. The computer program product in accordance with claim 10 wherein said code further comprises instructions to cause said gaming machine to highlight those cards yielding a combination of a Royal Flush when the player's hand did not comprise a Royal Flush.

18. The computer program product in accordance with claim 10 wherein said code further comprises instructions to cause said gaming machine to continue to display each discarded card.

19. The computer program product in accordance with claim 10 wherein said field of cards comprises a number of cards displayed in a N×N matrix.

20. A computer program product for causing a gaming machine having at least one video display to present a game, comprising:

machine readable code stored in a tangible medium comprising:

instructions to cause said gaming machine to select a sub-set of cards from a set of cards comprising all of the cards of a single deck of cards, said sub-set of cards comprising at least one set of cards forming a Royal Flush;

instructions to cause said gaming machine to deal a set of player cards from said sub-set of cards and display said set of player cards on said at least one video display of said gaming machine;

instructions to cause said gaming machine to display the remaining cards of said sub-set of cards in a field of cards at said at least one video display;

instructions to cause said gaming machine to accept input at said gaming machine regarding none, one or more or all of said cards of said set of player cards to discard;

instructions to cause said gaming machine to accept selection at said gaming machine of a replacement card from said field of cards for each discarded card;

instructions to cause said gaming machine to form a player hand comprising cards of said set of player cards not discarded plus any replacement cards; and instructions to cause said gaming machine to determine the outcome of said game by determining if said player hand is a winning hand.

21. The computer program product in accordance with claim 20 wherein said code further comprises instructions to cause said gaming machine to display said cards in said field of cards after said outcome of said game has been determined.

22. The computer program product in accordance with claim 20 wherein said code further comprises instructions to cause said gaming machine to determine if said player hand comprises a Royal Flush and, if not, highlight the set of cards forming said Royal Flush.

23. The computer program product in accordance with claim 20 wherein said code further comprises instructions to cause said gaming machine to continue to display each discarded card.

24. The computer program product in accordance with claim 20 wherein said sub-set of cards comprises 25-35 cards.

25. A gaming machine comprising:

a housing;

at least one user input;

at least one electronic video display configured to display game information to a player;

at least one data storage device;

a controller configured to receive information from said at least one user input and to display game information via said at least one electronic video display to said player; and instructions stored on the at least one data storage device and executable by said controller to present a game, the one or more instructions comprising:

instructions for displaying a field of cards in a face-down position on at least one electronic video display of said gaming machine;

instructions for dealing to a player a set of dealt cards and displaying said dealt cards on said at least one electronic video display of said gaming machine, the combination of dealt cards and cards in said field of cards comprising less than 52 cards and yielding at least one possible combination of a Royal Flush;

instructions for accepting input at said gaming machine regarding none, one or more or all of said dealt cards which said player wishes to discard;

instructions for accepting selection at said gaming machine from said field of cards a replacement card for each discarded card;

instructions for forming a player hand from cards from said set of dealt cards not discarded along with any replacement cards; and instructions for determining the outcome of said game by determining if said player hand is a winning hand.

26. A gaming machine comprising:

a housing;

at least one user input;

at least one electronic video display configured to display game information to a player;

at least one data storage device;

a controller configured to receive information from said at least one user input and to display game information via said at least one electronic video display to said player; and instructions stored on the at least one data storage device and executable by said controller to present a game, the one or more instructions comprising:

instructions for selecting a sub-set of cards from a set of cards comprising all of the cards of a single deck of cards, said sub-set of cards comprising at least one set of cards forming a Royal Flush;

instructions for dealing a set of player cards from said sub-set of cards and displaying said set of player cards on at least one electronic video display of said gaming machine;

instructions for displaying the remaining cards of said sub-set of cards in a field of cards at said at least one electronic video display;

instructions for accepting input at said gaming machine regarding none, one or more or all of said cards of said set of player cards to discard;

instructions for accepting selection at said gaming machine of a replacement card from said field of cards for each discarded card;

instructions for forming a player hand comprising cards of said set ofplayer cards not discarded plus any replacement cards; and instructions for determining the outcome of said game by determining if said player hand is a winning hand.

* * * * *